US006528771B1

(12) United States Patent
Matsen et al.

(10) Patent No.: US 6,528,771 B1
(45) Date of Patent: Mar. 4, 2003

(54) SYSTEM AND METHOD FOR CONTROLLING AN INDUCTION HEATING PROCESS

(75) Inventors: Marc R. Matsen, Seattle, WA (US); John A. Mittleider, Kent, WA (US); Richard T. Privett, Normandy Park, WA (US); Donald K. Dabelstein, Renton, WA (US)

(73) Assignee: The Boeing Company, Seattle, WA (US)

( * ) Notice: Subject to any disclaimer, the term of this patent is extended or adjusted under 35 U.S.C. 154(b) by 0 days.

(21) Appl. No.: 10/094,568

(22) Filed: Mar. 8, 2002

(51) Int. Cl.[7] ..... H05B 6/06
(52) U.S. Cl. ..... 219/634; 219/667
(58) Field of Search ..... 219/630, 633, 219/634, 645, 647, 603, 604, 615, 618, 622, 635, 646, 667

(56) References Cited

U.S. PATENT DOCUMENTS 4,816,633 A 3/1989 Mucha et al.
4,897,518 A 1/1990 Mucha et al.
RE33,644 E 7/1991 Hall
5,645,744 A 7/1997 Matsen et al.
5,728,309 A 3/1998 Matsen et al.
6,046,442 A 4/2000 Kawamura et al.

*Primary Examiner*—Tu Ba Hoang
(74) *Attorney, Agent, or Firm*—Alston & Bird LLP

(57) ABSTRACT

An induction heating system for fabricating a part by heating and forming the part. The induction heating system comprises a smart susceptor that includes a susceptor material that responds to an electromagnetic flux by generating heat and a cavity defined by the susceptor material that is configured to hold the part. An induction coil of the induction heating system is supplied with electrical power so as to generate the electromagnetic flux necessary for the susceptor to generate heat. A temperature controller includes a power supply that supplies electrical power to the induction coil. A controlling element of the temperature controller monitors trends in the electrical power supplied and changes the amount of electrical power being supplied so as to control the temperature of the part during fabrication.

22 Claims, 9 Drawing Sheets

SYSTEM AND METHOD FOR CONTROLLING AN INDUCTION HEATING PROCESS

FIELD OF THE INVENTION

The present invention relates to the use of induction heating systems, more particularly, to the use of smart susceptors to selectively heat a part or parts during a manufacturing process.

BACKGROUND OF THE INVENTION

Generally, induction heating processes may be carried out using any material that is electrically conductive and that generates heat when exposed to an electromagnetic flux field. Often, induction heating is used to directly heat an electrically conductive part during a manufacturing process. The electromagnetic flux field can be generated by an electromagnetic coil that surrounds the part and is supplied with alternating, or oscillating, electrical current from a power source. However, when a simple electromagnetic coil design and thorough heating of the part are desired, the induction heating process typically requires the use of a susceptor that encapsulates the part. Susceptors are not only electrically conductive, but also have a high thermal conductivity for a more efficient and thorough heating of the part. Therefore, manufacturing processes requiring localized heating, relatively quick heat-up and cool-down times, a more efficient use of power, or customized thermal properties that enable fabrication, benefit from induction heating processes that use susceptors.

Certain manufacturing processes require heating up to, but not beyond, a certain temperature. A select type of susceptor, often referred to as a "smart susceptor," is constructed of a material, or materials, that generate heat efficiently until reaching a threshold, or Curie, temperature. As portions of the smart susceptor reach the Curie temperature, the magnetic permeability of those portions drops precipitously. The drop in magnetic permeability has two effects, it limits the generation of heat by those portions at the Curie temperature, and it shifts the magnetic flux to the lower temperature portions causing those portions below the Curie temperature to more quickly heat up to the Curie temperature.

Mechanical part manufacturing processes often require the controlled application of heat, such as when consolidating composite panels, or for metal forming processes such as brazing and superplastic forming. To this end, smart susceptors have been employed in combination with dies for mechanical forming such as the invention described in U.S. Pat. No. 5,728,309 to Matsen et al. commonly assigned and incorporated herein by reference. Matsen discloses an induction heating workcell 10 that includes a pair of ceramic dies 20, 22 mounted within a pair of strongbacks 24, 26. A pair of cavities 42, 44 defined by the dies hold respective ones of a pair of tool inserts 46, 48. A retort 60 is positioned between the tool inserts and includes a pair of susceptor sheets sandwiching a pair of metal, or composite, part panels. The tool inserts define a contoured forming surface 58 that has a shape corresponding to the desired shape of the upper and lower mold line surfaces of the completed part. An induction coil 35 is embedded into the dies and surrounds the cavities, tool inserts and the retort.

Suction pressure can be used to hold the susceptor halves to the dies when handling the dies before the start of the process. During the process, the retort is heated to forming or consolidation temperature by energizing the induction coil which generates an electromagnetic flux field. The flux field causes the susceptor plates to generate heat, while the dies and tool inserts have a relatively low magnetic permeability and therefore generate little heat. Internal tooling pressure is used to hold the susceptors against the dies during processing. This pressure is either supplied by sealing around the perimeter of the dies or using pressurized bladders. The application of heat and pressure is continued until the metal part panels are properly brazed, or formed, or the resin in the composite panels is properly distributed to form the completed part.

Advantageously, the susceptor may be custom tailored to the desired thermal leveling temperature by using different alloy materials such as cobalt/iron, nickel/iron, iron/silicon, or amorphous or crystalline magnetic alloys. Also, the susceptor can be designed to have several different thermal leveling temperatures by using multiple layers of different alloys that are tuned to different Curie temperatures. Control of the thermal processing temperature at the thermal leveling point, however, is also important because the processing temperature about the leveling point may vary as much as ±10° F. Supplying too much power results in an overshoot of the desired processing temperature, while supplying too little power results in a long wait for the susceptor and part to reach the processing temperature.

One existing control scheme employs thermocouples to provide feedback for power control about the thermal leveling point. The thermocouples are positioned in different locations about the work piece, and the temperature data from each of the thermocouples is used to calculate an average temperature. Each of the thermocouples must be properly calibrated so as to ensure accurate readings. In addition, the thermocouples are delicate and give faulty thermocouple readings when damaged. Such faulty thermocouple readings must be discovered and discarded before calculating the average temperature. Despite existing control schemes, improvements over the measurement and control of the temperature and timing of the induction heating process are still highly desired to produce parts of increasing quality.

Therefore, it would be advantageous to provide an induction heating system in which the temperature of the part can be easily controlled or fine-tuned. More particularly, it would be advantageous to have an induction heating control system that allows temperature control of a smart susceptor about its Curie point. Further, it would be advantageous to have an induction heating control system that did not require the use of multiple thermocouples, large amounts of data processing, or other complex electrical devices to monitor and control the temperature of the part.

SUMMARY OF THE INVENTION

The present invention addresses the above needs and achieves other advantages by providing an induction heating system for fabricating a part by heating and forming the part while more easily controlling the operating temperature. The induction heating system comprises a smart susceptor that includes a susceptor material that responds to an electromagnetic flux by generating heat and a cavity defined by the susceptor material that is configured to hold the part. An induction coil of the induction heating system is supplied with electrical power so as to generate the electromagnetic flux necessary for the susceptor to generate heat. A temperature controller includes a power supply that supplies electrical power to the induction coil. A controlling element of the temperature controller monitors trends in the electrical power supplied and changes the amount of electrical power being supplied so as to control the temperature of the part during fabrication.

In one embodiment, the present invention includes a smart susceptor, a coil and a temperature controller. The smart susceptor includes a susceptor material that defines a cavity that is configured to receive the part. The susceptor material is configured to respond to an electromagnetic flux by generating heat. Generation of heat by the susceptor material increases the temperature of the part in the cavity. The coil is positioned in proximity to the smart susceptor and is capable of generating the electromagnetic flux when supplied with electrical power. The temperature controller of the induction heating system has a power supply and a controlling element. The power supply is operably connected to the electromagnetic coil so as to supply an amount of the electrical power to the electromagnetic coil. The controlling element is configured to measure trends in the amount of the electrical power supplied by the power supply and is further configured to change the amount of the electrical power being supplied so as to control the temperature of the part in the cavity during fabrication.

The controlling element is further configured to continuously vary the amount of electrical power supplied to the coil in order to follow a predetermined pattern for the temperature of the part.

The susceptor material has a high magnetic permeability when below a Curie temperature and a low magnetic permeability when above the Curie temperature. Preferably, a predetermined maximum temperature necessary for fabrication of the part is approximately equal to the Curie temperature of the susceptor material. In such an aspect, the controller may be further configured to reduce the amount of electrical power supplied to the coil as the temperature of the susceptor material reaches the Curie temperature.

The temperature controller may include a voltage sensor operable to measure a voltage across the coil and wherein the controlling element may be further configured to control the amount of power supplied in response to a change in the voltage. In particular, the controller is configured to control the amount of power supplied to the coil so as to maintain a predetermined voltage measured by the voltage sensor.

The cavity may completely enclose the part. Optionally, the induction heating system further comprises a die having two portions and the smart susceptor has two separable portions. Each of the portions of the smart susceptor are attached to a respective one of the portions of the die. The die is configured to hold the portions together so as to define the cavity.

In another aspect, the coil defines a coolant pathway configured to receive a fluid coolant which draws heat from the coil during fabrication of the part.

The present invention has several advantages. Measurements of the voltage, or power, supplied to the coil provides an indication of when the susceptor temperature has reached the Curie point. Control of the power being supplied to the coil, therefore, allows the temperature of the susceptor, and hence the part, to be fine tuned without the use of complex electrical control devices and thermocouples that are prone to inaccuracy and breakage. Restated, the amount of power being supplied to the coil provides an indication of the global temperature of the part being manufactured and provides an effective indication of leveling off, or stabilization, of the part temperature. In addition, the power, or voltage, being supplied is a single number that can be easily monitored and controlled. Further, the susceptor requires no calibration beyond its initial chemical composition because there is no variation in the Curie point of the susceptor material.

BRIEF DESCRIPTION OF THE DRAWINGS

Figure 1:
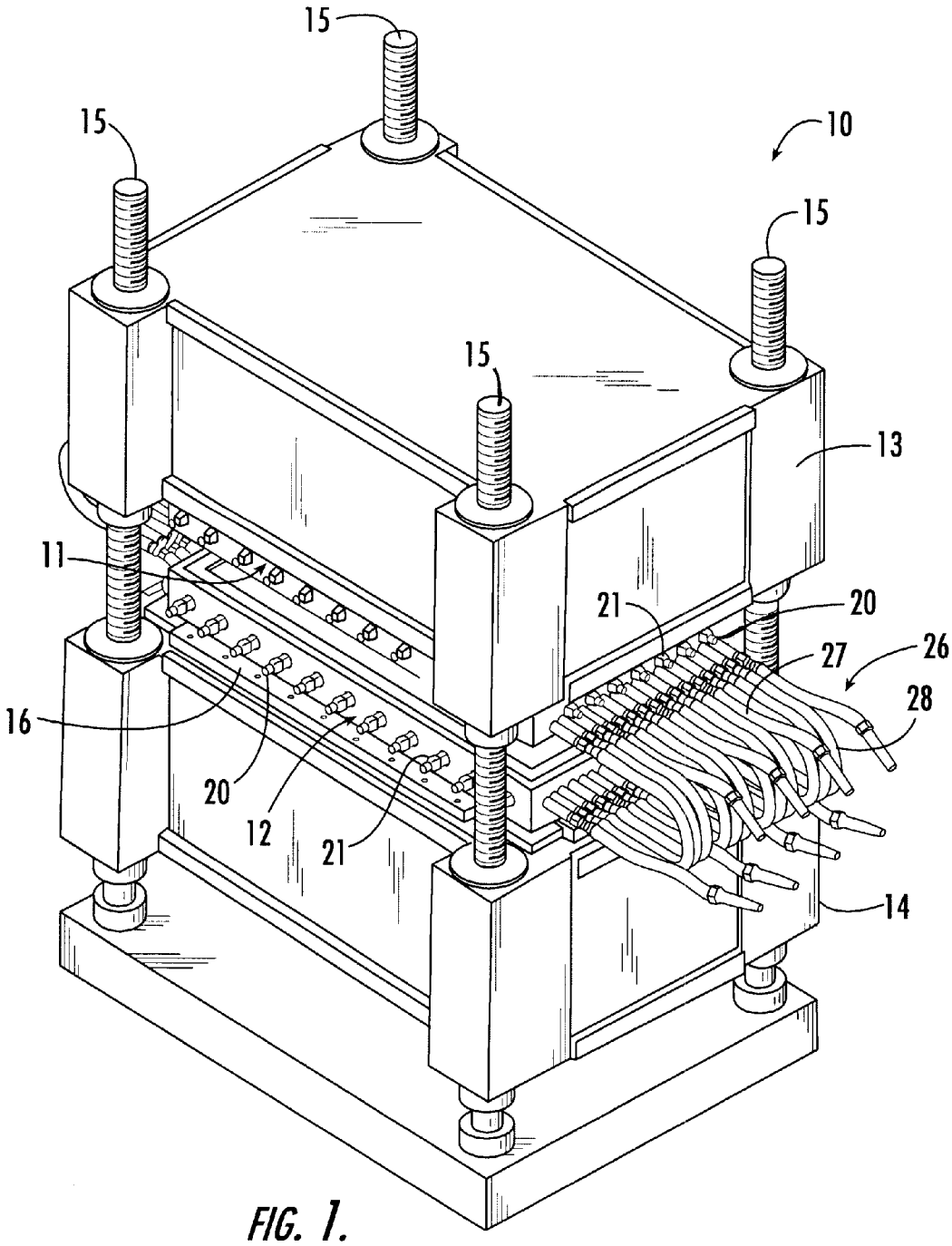
Figure 2:
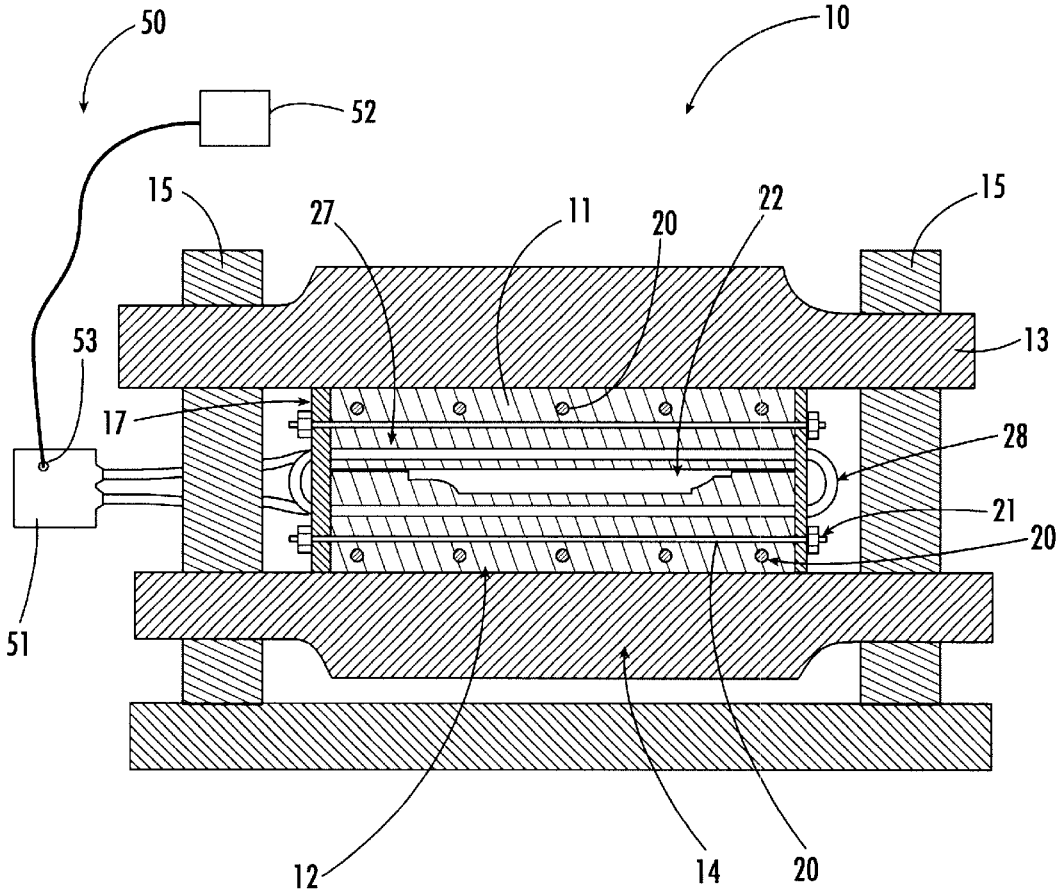
Figure 3:
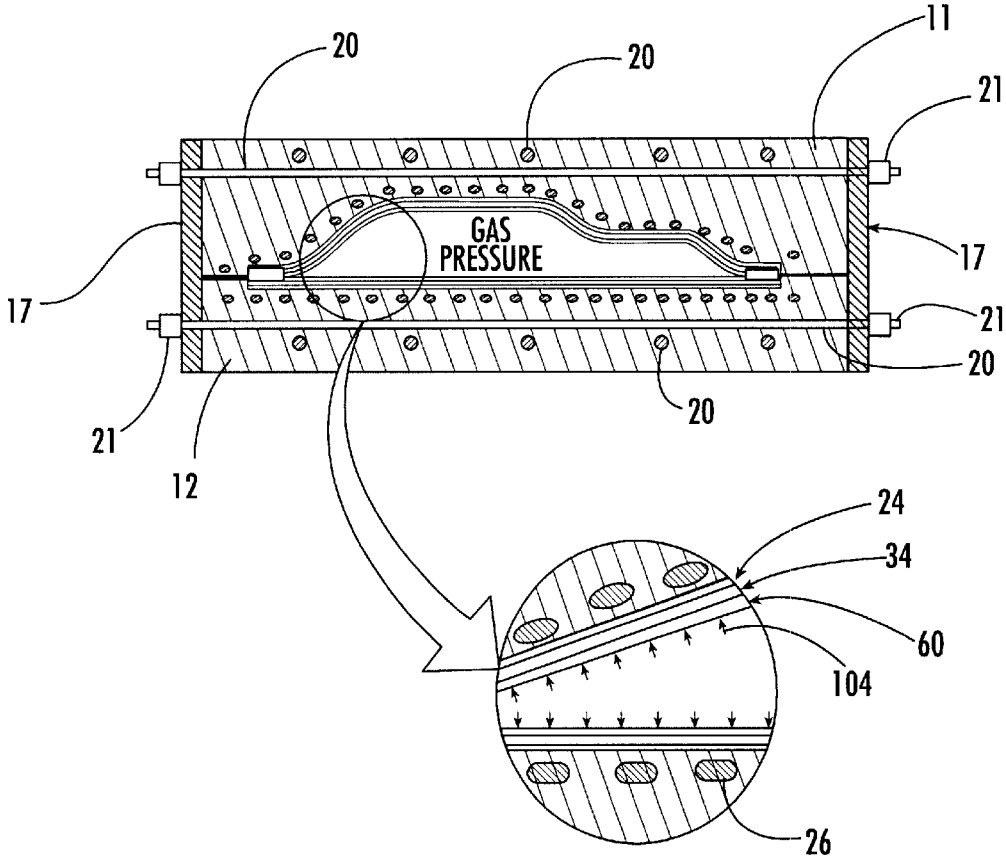
Figure 4A:
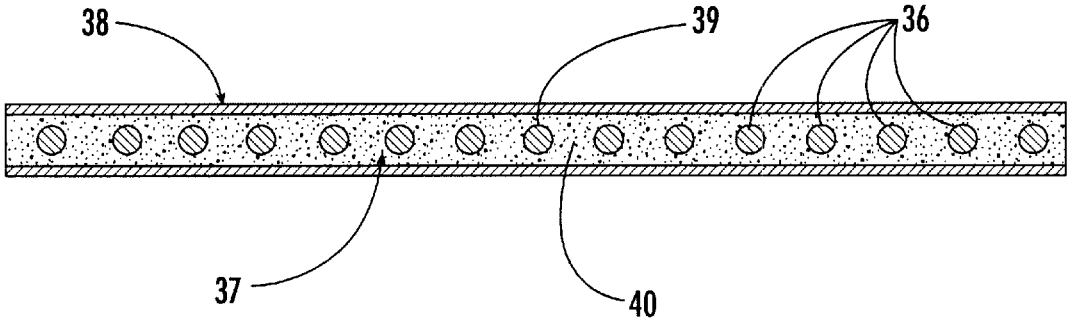
Figure 4B:
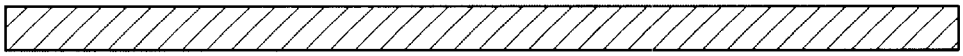
Figure 5A:
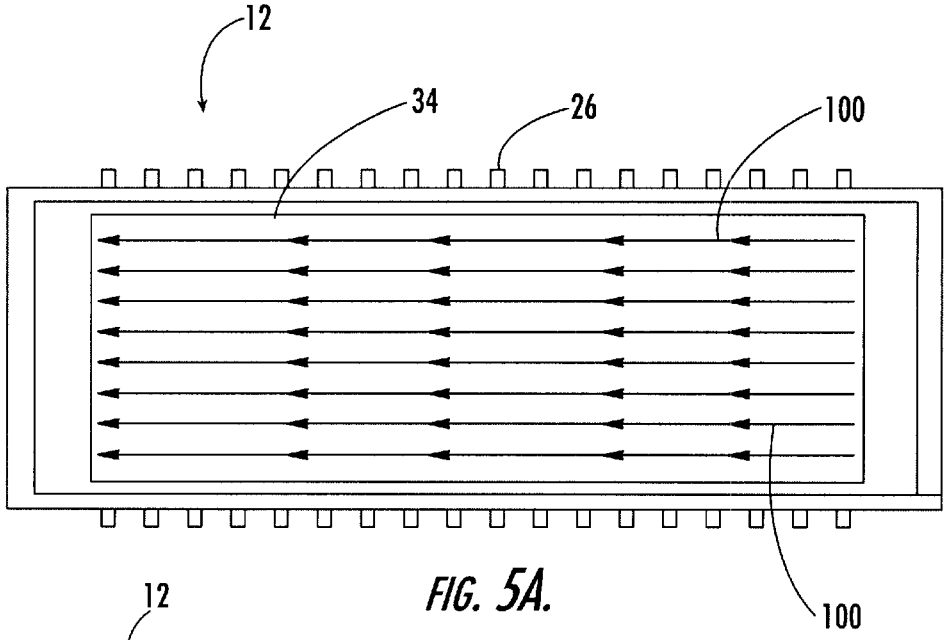
Figure 5B:
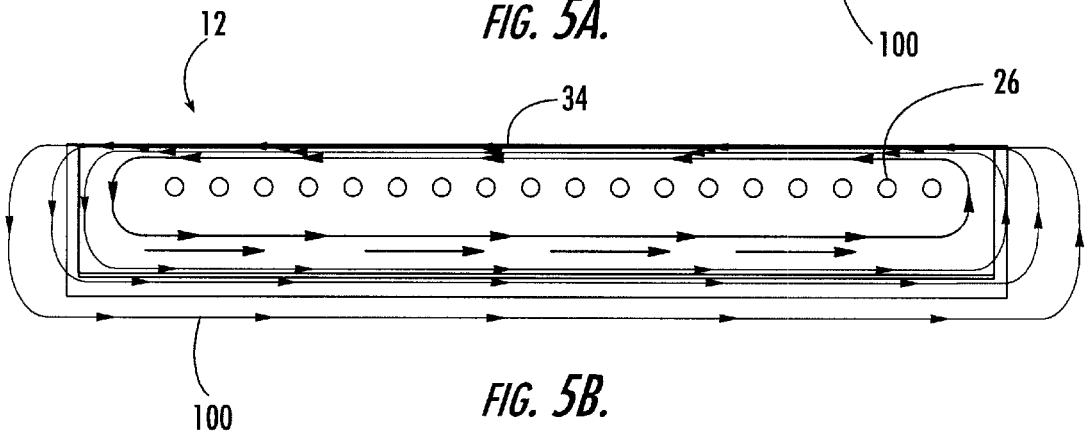
Figure 6A:
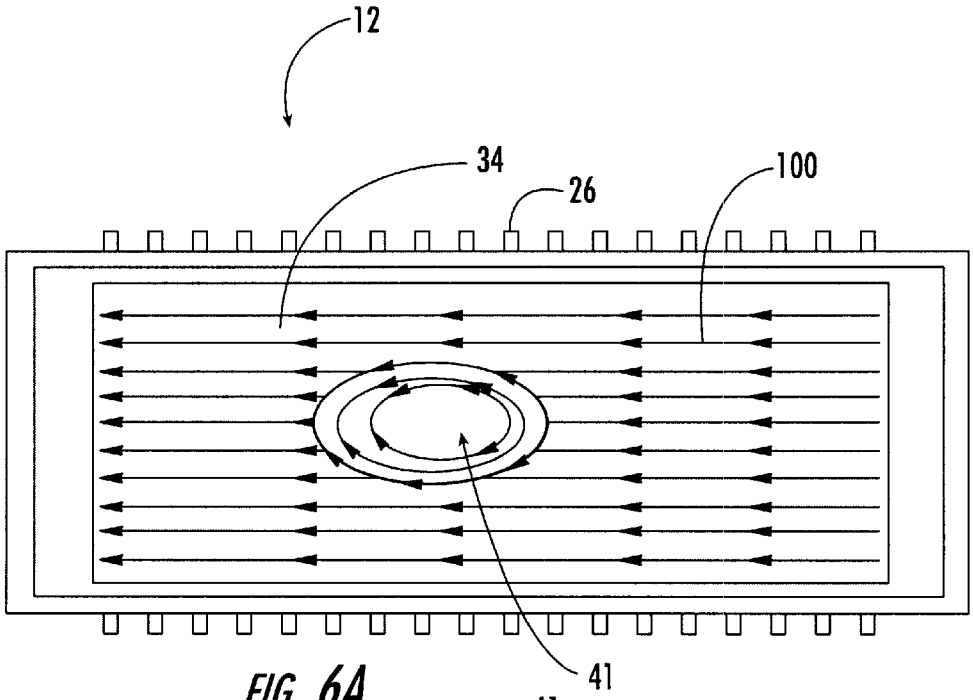
Figure 6B:
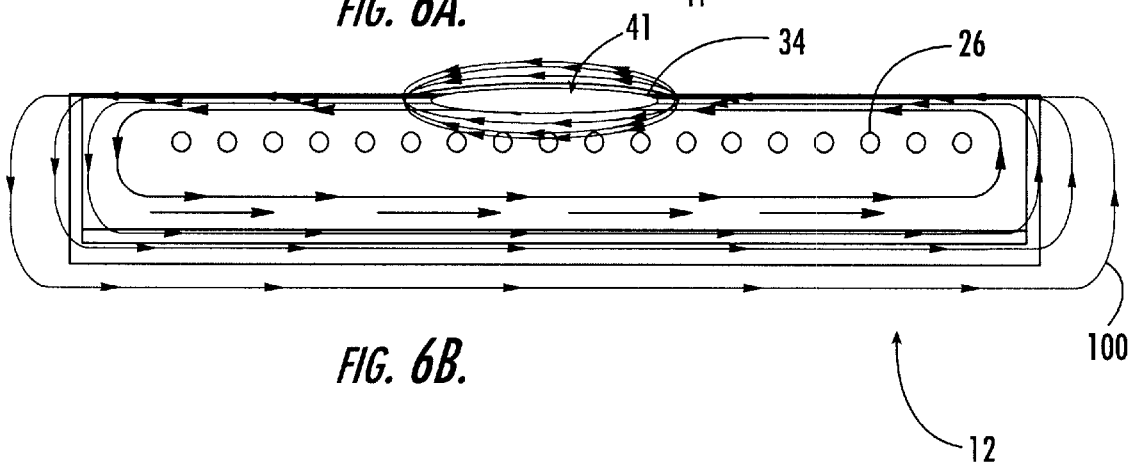
Figure 7A:
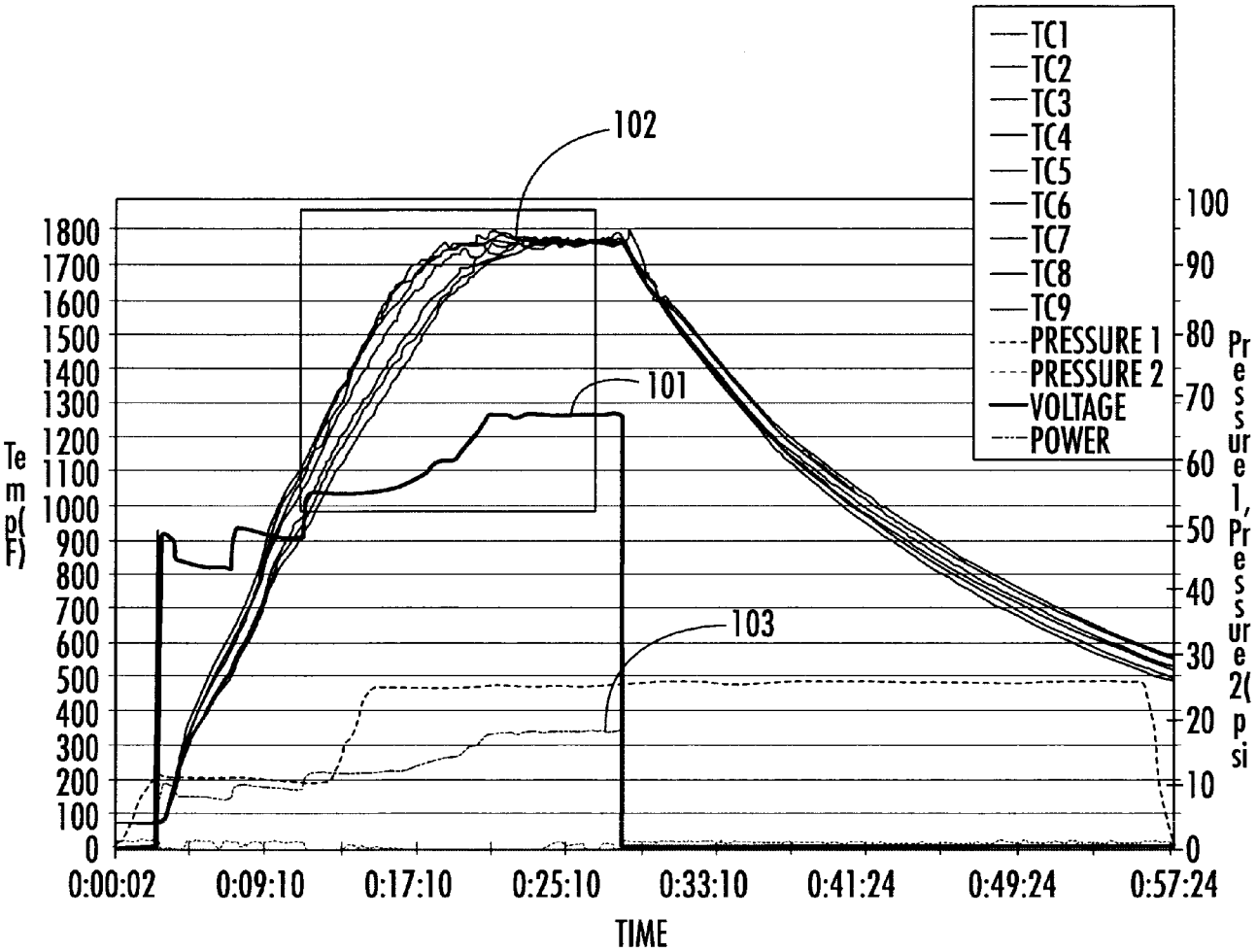
Figure 7B:
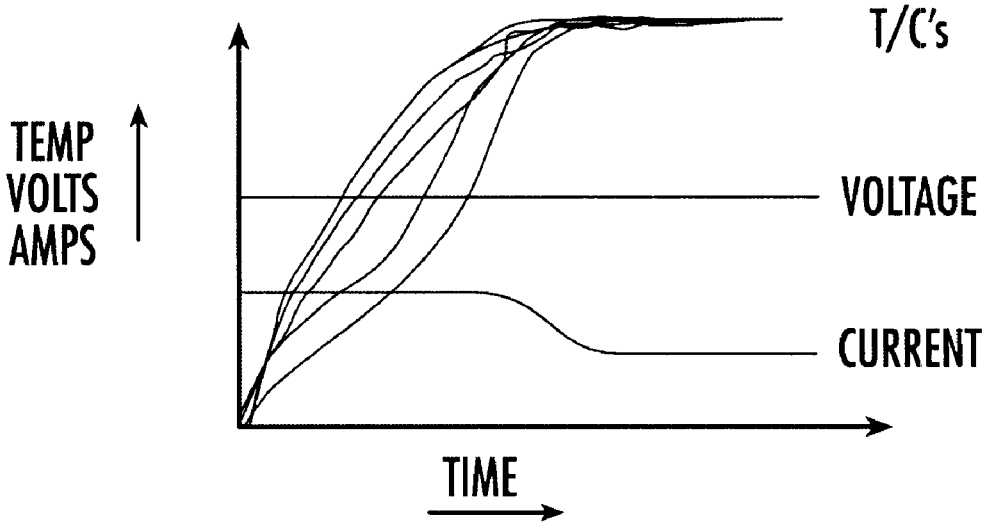
Figure 8A:
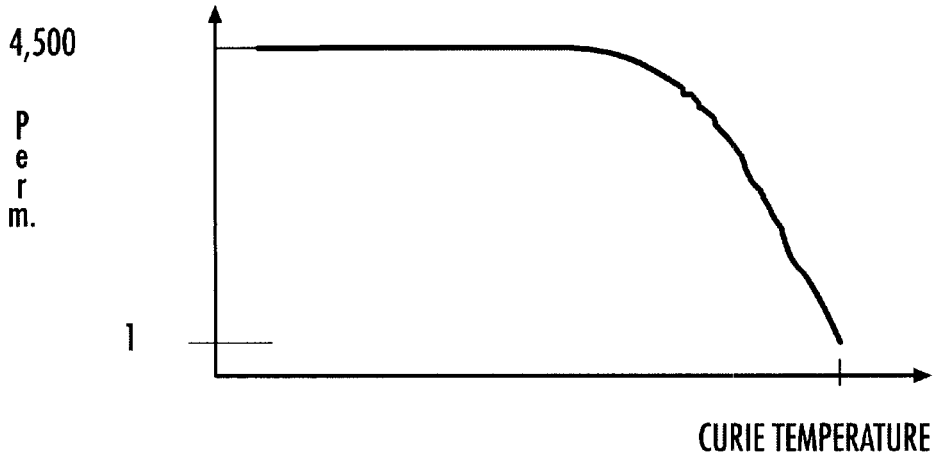
Figure 8B:
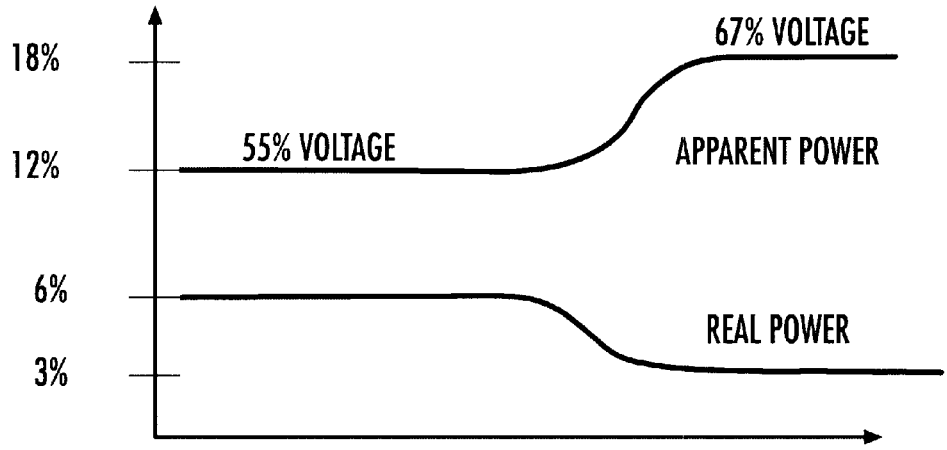

Having thus described the invention in general terms, reference will now be made to the accompanying drawings, which are not necessarily drawn to scale, and wherein:

FIG. 1 shows a perspective view of an induction heating workcell of one embodiment of the present invention;

FIG. 2 is a schematic diagram of the workcell shown in FIG. 1 including a temperature control system of another embodiment of the present invention;

FIG. 3 is a schematic of a pair of dies of the workcell shown in FIG. 1, wherein the pair of dies define a cavity which contains a thermally sprayed susceptor forming a metal part;

FIG. 4A is a cross-section of the thermally sprayed susceptor shown in FIG. 3;

FIG. 4B is a cross-section of a rolled sheet alloy constructed using powdered metallurgy used in a susceptor of another embodiment of the present invention;

FIG. 5A is a plan view of a bottom one of the dies shown in FIG. 3 holding a bottom portion of the susceptor shown in FIG. 3;

FIG. 5B is a side elevation view of the bottom die and bottom susceptor portion shown in FIG. 5A;

FIG. 6A is a plan view of the bottom die and bottom susceptor portion of FIG. 5A showing a region of magnetic impermeability in the susceptor;

FIG. 6B is a side elevation view of the bottom die and bottom susceptor portion with the region of magnetic impermeability shown in FIG. 6A;

FIG. 7A is a graph showing heating and forming of a part using the temperature control system of FIG. 2;

FIG. 7B is a graph showing heating and forming of a part using a constant voltage control of another embodiment of the present invention;

FIG. 8A is a graph showing a decrease in magnetic permeability of the smart susceptor shown in FIG. 3 as its temperature increases; and FIG. 8B is a graph showing an increase in induction coil power concomitant with the decrease in susceptor magnetic permeability shown in FIG. 8A.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In one embodiment, the present invention includes an induction heating workcell 10, as shown in FIG. 1. The workcell includes an upper die 11 mounted within an upper strongback 13 and a lower die 12 mounted within lower strongback 14. The strongbacks are each threaded onto four threaded column supports, or jackscrews 15 allowing adjustment of the relative positions of the dies and strongbacks. Together, the dies 11, 12 define a die cavity 22 that is shaped hold a smart susceptor 34 that, in turn, surrounds a part 60, such as a geometrically complex titanium part for an aircraft, as shown in FIGS. 2 and 3. A plurality of induction coils 26 are embedded in the die and surround the susceptor 34. When energized, the coils 26 create a magnetic flux field that causes the susceptor 34 to generate heat so as to perform a step in manufacturing the part 60, such as forming a metal part, or consolidating a composite part.

The induction heating workcell 10 further includes a set of clamping bars 16 that hold the dies in place against the strongbacks 13, 14. The strongbacks provide a rigid, flat backing surface for the upper and lower dies 11, 12 which prevents the dies from bending and cracking during the manufacturing operation. Additionally, the strongbacks serve as stiff plates that keep the dies together and accurately positioned. The strongbacks may be constructed of steel, aluminum, or any other material capable of handling the loads present during forming or consolidation. Preferably, nonmagnetic materials are used to prevent distortion of the magnetic fields produced by the induction coil 26 and to prevent unwanted energy losses to the press structure. As an alternative to the use of strongbacks, the dies 11, 12 themselves may be strong enough to withstand the loads present during forming or consolidation. In the embodiment depicted in FIGS. 1 and 2, the strongbacks have a rectangular box shape, but may be varied in shape and size to accommodate a myriad of desired die sizes and shapes.

Each of the dies 11, 12 includes a rectangular block of ceramic material 23 reinforced by a set of fiberglass rods 20 and a set of support plates 17. The support plates are preferably a set of phenolic boards arranged in the shape of a rectangular box framing each ceramic block 23. The phenolic boards 17 serve as containment walls during casting of the ceramic blocks 23 and also provide reinforcement during the subsequent induction heating process. Phenolic boards are typically composite plates including linen, or other fibers, suffused with an epoxy resin. As shown in FIG. 1, the fiberglass rods 20 extend longitudinally in a first array, and transversely in a second array, so as to form a grid through each ceramic material block 23. The ends of the fiberglass rods are threaded and extend through respective, opposing ones of the phenolic boards 17. The grid is embedded into the ceramic block 23 by extending the fiberglass rods 20 through the phenolic boards 17 before casting the ceramic material block 23.

After the block of ceramic material is cast, a set of nuts 21 are placed on the threaded ends of the fiberglass rods and are tightened so as apply a compressive load on the phenolic boards 17. The compressive load on the boards results in a pre-stressed, compressive load on the ceramic material block 23. The pre-stressed compressive load cancels the tensile loads developed during the induction heating process. Maintaining the ceramic block in compression is advantageous due to the poor tensile properties of ceramic materials. Other materials may be used to construct the material block 23, but ceramic (specifically Ceradyne 120) is preferred because it is a thermal insulator and has a low coefficient of thermal expansion. The low coefficient of thermal expansion allows the block to be subjected to steep thermal gradients without spalling of the material. In addition, the ceramic serves to insulate the die cavity 22 against heat loss, conserving the heat generated by the susceptor 34 and shortening the cycling times for heating and cooling the part 60. Further, such characteristics provide additional flexibility in the design of thermal cycles for various types of parts, resulting in an overall performance improvement.

The induction coils 26 are also embedded into the ceramic material blocks 23 during casting and are positioned between the fiberglass rods 20 and surround the die cavity 22, as shown in FIGS. 1–3. Preferably, the coils 26 are fabricated from 1 inch diameter, 0.0625 inch wall thickness, round copper tubing which is lightly drawn. The preferred lightly drawn condition of the tubing enables precision bending by numerical bending machines, as is known to those of skill in the art. Numerical bending of the tubes allows accurate placement of the tubing around the cavity 22, which is important due to the need to evenly distribute the electromagnetic flux. The coils 26 also remove thermal energy by serving as a conduit for a coolant fluid, such as water. After being bent and embedded, the coils 26 include straight tubing sections 27 connected by flexible tubing sections 28. The flexible tubing sections connect the straight tubing sections 27 and also allow the dies 11, 12 to be separated. Preferably, the thickness of the cast ceramic between the susceptor 34 and the coils 26 is about ¾ of an inch, which is sufficient to support the temperature gradient between the heated susceptor and the water-cooled coils. FIG. 3 illustrates the close positioning of the coils along the contours of the die cavity 22, and the susceptor 34 contained therein. The accurate placement of the tubing of the coils 26 around the cavity promotes uniformity in the amount of heat generated by the magnetic flux field, and the amount of heat removed by flow of the coolant fluid.

The induction coils 26 are connected to a temperature control system that includes a power supply 51, a controlling element 52, a sensor 53 and a fluid coolant supply preferably containing water (not shown). The power supply 51 supplies an oscillating current, preferably at 3 KHz, to the coils 26 which causes the coils to generate the electromagnetic flux field. The fluid coolant supply supplies water to the induction coils 26 for circulation through the coils and the removal of thermal energy from the dies 11, 12. The sensor 53 is capable of measuring the power supplied by the power supply 51. Alternatively, or in addition to measuring the power supply, the sensor 53 includes a voltmeter that can measure the voltage drop across the induction coils 26. The controlling element gathers the power supply, or voltage measurements from the sensor 53 and uses the measurements in a feedback loop to adjust the power being supplied by the power supply 51. The controlling element can include hardware, software, firmware, or a combination thereof that is capable of using feedback to adjust the power supply 51.

As shown best in FIG. 3, the susceptor 34 of the present invention is a layer, or sheet, of magnetically permeable material positioned along the inside surface of the die cavity 22. Preferred magnetically permeable materials for constructing the susceptor 34 include ferromagnetic materials that have an approximately 10 fold decrease in magnetic permeability when heated to a temperature higher than a critical, or Curie, temperature. Such a large drop in permeability at the critical temperature promotes temperature control of the susceptor and, as a result, temperature control of the part being manufactured. Ferromagnetic materials include the five elements Fe, Co, Ni, Gd and Dy, and alloys of those elements.

The die cavity itself is shaped to roughly conform to the shape of the susceptor 34 so as to provide support for the susceptor. In the embodiment shown in FIG. 3, the upper die 11 defines a portion of the cavity 22 that has a shape with multiple contours, while the lower die 12 defines a planar shape. It should be noted that other, more or less complex, shapes can be defined by the contours of both the upper and lower die portions of the cavity 22 and the depicted embodiment should not be viewed as limiting. The die cavity may also be coated with a protective liner 24 for improved durability of the dies 11, 12 against wear caused by insertion and removal of the susceptors and against heat generated by the susceptors. Preferred materials for the liner include $Al_2O_3$ fiber with an alumina-silicate or alumina matrix, or silicon carbide fibers in a silcon carbide matrix, a total of about 0.100 inches thick. The susceptor 34 in the embodiment depicted in FIG. 3 includes an upper and lower portions that are receivable into the cavity 22 defined by the upper and lower dies 11, 12. It should be noted that the susceptor can have several portions, each contacting a respective portion of the part.

In one embodiment, the susceptor 34 of the present invention is a thermally sprayed, smart susceptor that includes a mesh structure 36 supporting a magnetically permeable, thermally sprayed material 37 and optionally including a nickel aluminide coating 38, as shown in FIG. 4A. The mesh structure 36 is preferably a wire mesh constructed of stainless steel, or of a metal having the same composition as the thermally sprayed material 37 that can withstand the temperature and other environmental factors associated with heating and forming of the part 60. The mesh structure 36 provides a skeleton, or support structure, that holds the together the sprayed material 37. More preferably, the wire mesh structure 36 is a very flexible mesh weave that can closely drape to the shape of a model worked or machined to the contours of the desired final part geometry. In one example, the mesh structure 36 is comprised of .020 inch thick, 300 series stainles steel wire. Further preferably, the mesh structure 36 should have sufficiently sized interstices 40 between its wires 39 to allow interdigitation of the sprayed material 37 within the mesh structure, while at the same time providing support for the sprayed material. Use of the wire mesh structure 36 is described more fully in commonly assigned U.S. patent application Ser. No. 10/094,494 entitled "Smart Susceptor Having a Geometrically Complex Molding Surface," and incorporated herein by reference filed Mar. 8, 2002. In an alternative embodiment, the susceptor may be constructed of a rolled alloy sheet formed using powder metallurgy, as shown in FIG. 4B, and is particularly applicable for less complicated shapes.

The preferred method of constructing the smart susceptor 34 using the mesh structure includes machining, or forming, a model of the desired part geometry from richlite or aluminum. The mesh structure 36 is draped over the contours of the model and may be tacked, glued, or otherwise attached, to the surface of the model. The material 37 starts in a powder form and is heated and sprayed from a plasma spray gun onto the mesh-covered part model until the sprayed material reaches a desired thickness. The susceptor 34 is released from the model by removal of the glue or tacks and is subjected to a bright annealing and sintering operation to consolidate the wire mesh structure 36 with the thermally sprayed material 37. Preferably, the annealing and sintering is performed in a hydrogen gas furnace so as to reduce oxidation in the susceptor and to increase the density of the susceptor. As shown in FIG. 4A, a nickel aluminide coating 38 is also thermally sprayed on both sides of the susceptor 34 after completion of the annealing and sintering operation.

The composition of the thermally sprayed material 37 and wire mesh structure 36 can be varied to approximately match the desired range of operation temperature(s) of the smart susceptor 34, as described in U.S. Pat. No. 5,728,309 to Matsen et al., commonly assigned, and incorporated herein by reference as above. For instance, Matsen describes some of the various alloys, and other materials, that exhibit smart susceptor characteristics and their respective Curie temperatures in column 13, Tables 1 and 2.

The process of heating and forming the part includes inserting sheets of titanium, or other metal or composite, into the cavity 22 defined by the upper and lower dies 11, 12 and between the upper and lower portions of the smart susceptor 34 supported therein, when the dies are spaced apart along the threaded column supports 15. Optionally, the dies 11, 12 may be removed from the column supports. The dies 11, 12 are then brought together by movement along the column supports 15 until the part sheets and the susceptor 34 are enclosed in the cavity 22 and the cavity is sealed. The temperature controller 50 allows the power supply 51 to supply a predetermined amount of power, as shown graphically in FIG. 8B. The power is supplied to the induction coils 26 causing an oscillating current in the coils which generates an electromagnetic flux field. As shown by FIGS. 5A and 5B, the flux field, depicted as flux lines 100, travel directly through the ceramic material 23 of the lower die 12 due to its lack of electrical conductivity and couple with the magnetically permeable material of the susceptor 34. Coupling with the magnetic flux field induces eddy currents in the susceptor, which, in turn, results in the generation of heat. The heat increases the temperature of the susceptor which, being adjacent to the titanium sheets of the part 60 and trapped therewith in the cavity 22 of thermally insulative ceramic material 23, results in a temperature increase of the part, as shown by the thermocouple readings 102 of FIG. 7A. The differences in the thermocouple readings are a result of different locations of the thermocouples.

The average temperature of the part 60 increases at a roughly steady rate, with the aforementioned variances between part locations, until a portion 41, or portions, of the susceptor 34 reach the Curie temperature. The temperature of the dies 11, 12 and induction coils 26 is kept relatively low by a supply of the coolant fluid through the tubes of the induction coils. Upon reaching the Curie temperature, those portions of the susceptor experience a sudden drop in magnetic permeability, wherein the permeability approaches unity, as shown in FIG. 8A. The sudden drop in magnetic permeability results in a distortion of the magnetic flux generated by the induction coils 26 which moves out of the impermeable area of the susceptor 34, as shown by the flux lines 100 of FIGS. 6A and 6B. The remaining portions of the susceptor continue to receive flux and generate heat, and may even produce more heat due to the magnetic flux being pushed out of the portions at the Curie temperature and into the remaining portions of the susceptor.

Eventually, the entire susceptor 34 reaches the Curie temperature and experiences a drop in magnetic permeability. The decrease in magnetic permeability of the susceptor also coincides with a decrease in the inductance of the coil and the amount of energy absorbed by the part 60, as shown in FIG. 8B. Concomitant with the decrease in the magnetic permeability of the susceptor, the sensor 53 detects an increase in the voltage of the power supply 51. The voltage rise, therefore, can be related to the permeability drop, which, in turn, relates to the global temperature of the susceptor 34 and the part 60. This effect is illustrated in FIG. 7A, which shows voltage readings 101 and power readings 103 begin to rise as the thermocouple readings 102 begin to approach the Curie temperature. The voltage readings 101 begin to flatten out once all of the thermocouples are at the Curie temperature.

The controlling element 52 detects the sudden change in voltage, current or power using the sensor 53 and can control the power supply 51 without the need for thermocouples, or other direct temperature sensing devices. Generally, the range of temperature control is about ±10° F. over a 20° F. window around the Curie point. There are three preferred modes of controlling the power supply, and hence monitoring and controlling the global temperature of the part. Most preferably, the power supply 51 can be constant voltage controlled, as shown in FIG. 7B. With a constant voltage, the current is allowed to change as the load changes. In this case, the controlling element 52 is a potentiometer on the power supply that sets the voltage at a predetermined level. The power supply tries to maintain the predetermined voltage as the susceptor 34 heats up and begins its transition into a non-magnetic state. Maintaining the voltage requires that the current output of the power supply be steadily decreased as the susceptor reaches the Curie temperature. Several heating cycles allows optimization of the constant voltage setting for improved temperature control and processing speed of each part configuration.

In another embodiment, the power supply 51 can be constant current controlled. With a constant current, the voltage is allowed to change as the load changes while the current is set at a predetermined level by a potentiometer. To maintain the current, the voltage is raised as the susceptor 34 begins its transition to the non-magnetic state. In still another embodiment, the power supply can be constant power controlled by allowing the current and voltage to change at a predetermined ratio while the load changes so that constant power is delivered to the part 60. Once the load stops changing, the part is at the desired temperature. In each of the embodiments, it can be determined if insufficient power is being supplied when the controlled variable begins to change on its own, without input from the potentiometer. It should be noted that the present invention is not limited to potentiometer controlled power supplies. The voltage, current and/or power output of a power supply can be controlled using many different devices and methods, such as by variable switching of a field effect transistor.

While the susceptor 34 is at the Curie temperature, the titanium part 60 is formed due to the internal pressure caused by heating the part, as shown by the pressure arrows 104 of FIG. 3. As described above, the smart susceptor 34 includes a mesh screen 36 supporting a thermally sprayed material 37 that has been closely conformed to the shape of the desired part geometry. As the temperature of the susceptor 34 and part 60 increase, the pressure of the air trapped between the titanium sheets increases and forces the sheets away from each other and against the complex molding surfaces of the susceptor. Air between the dies 11, 12 and the part 60 is allowed to escape through vent holes (not shown) in the dies so as to avoid inhibiting formation of the part.

The present invention has several advantages. Measurements of the voltage, or power, supplied to the coil 26 provides an indication of when the susceptor temperature has reach the Curie point. Control of the power being supplied to the coil, therefore, allows the temperature of the susceptor 34, and hence the part, to be fine tuned without the use of complex electrical control devices and thermocouples that are prone to inaccuracy and breakage. Restated, the amount of power being supplied to the coil provides an indication of the global temperature of the part being manufactured and provides an effective indication of leveling off, or stabilization, of the part temperature. In addition, the power, or voltage, being supplied is a single number that can be easily controlled and requires no calibration because there is no variation in the Curie point of the susceptor material. Constant voltage control is particularly advantageous because the current supplied drops as the susceptor becomes demagnitized, leading to a naturally limiting process.

Many modifications and other embodiments of the invention will come to mind to one skilled in the art to which this invention pertains having the benefit of the teachings presented in the foregoing descriptions and the associated drawings. For instance, the mesh weave 36 can be used to support flexible susceptor material 37 that has been deposited using other processes, such as electroplating. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An induction heating system for fabricating a part by heating and forming the part, the induction heating system comprising:

a susceptor including a susceptor material defining a cavity configured to receive the part, said susceptor material configured to respond to electromagnetic flux applied thereto by generating heat so as to increase a temperature of the part in the cavity;

a coil positioned in proximity to the susceptor and capable of generating the electromagnetic flux when supplied electrical power; and a temperature controller having a power supply and a controlling element, said power supply operably connected to the coil to supply an amount of the electrical power thereto, said controlling element configured to measure trends in output of the power supply and further configured to change the amount of electrical power being supplied so as to control the temperature of the part in the cavity during fabrication based upon the measured trends.

2. An induction heating system of claim 1, wherein the controlling element is further configured to continuously vary the amount of electrical power to follow a predetermined pattern for the temperature of the part.

3. An induction heating system of claim 1, wherein the susceptor material has a high magnetic permeability when below a Curie temperature and a low magnetic permeability when above the Curie temperature.

4. An induction heating system of claim 3, wherein a predetermined maximum temperature necessary for fabrication of the part is approximately equal to the Curie temperature of the susceptor material.

5. An induction heating system of claim 4, wherein the controller is further configured to reduce the amount of electrical power supplied to the coil as the temperature of the susceptor material reaches the Curie temperature.

6. An induction heating system of claim 1, wherein the temperature controller includes a voltage sensor operable to measure a voltage across the coil and wherein the controlling element is further configured to control the voltage of power supplied by the electrical supply.

7. An induction heating system of claim 6, wherein the controller is further configured to maintain a predetermined voltage.

8. An induction heating system of claim 1, wherein the cavity completely encloses the part.

9. An induction heating system of claim 8, further comprising a die having at least two portions and wherein the smart susceptor has at least two separable portions, each of the portions of the smart susceptor attached to a respective one of the portions of the die, wherein said die is configured to hold the die portions together so as to define the cavity.

10. An induction heating system of claim 1, wherein the coil defines a coolant pathway configured to receive a fluid coolant which draws heat from the coil during fabrication of the part.

11. An induction heating system of claim 1, wherein the temperature controller includes a current sensor operable to measure a current of power supplied to the coil and wherein the controlling element is further configured to maintain a predetermined current of power supplied by the power supply.

12. An induction heating system of claim 1, wherein the controlling element is further configured to maintain a predetermined amount of power supplied by the power supply.

13. An induction heating system of claim 1, wherein the susceptor is constructed of a ferromagnetic material having at least a 10 fold decrease in magnetic permeability above a critical temperature.

14. A method for controlling an induction heating process for fabricating a part by heating and forming the part, the method comprising:

supplying electrical power to an induction coil using a power supply;

generating an electromagnetic flux field with the induction coil;

generating heat with a susceptor positioned in the electromagnetic flux field and heating the part held in a cavity defined by the susceptor;

sensing trends in an amount of electrical power supplied by the power supply with a controlling element; and controlling, with the controlling element, a temperature of the part by controlling the amount of electrical power supplied by the power supply.

15. A method of claim 14, wherein controlling the temperature includes controlling the amount of electrical power to follow a predetermined pattern for the temperature of the part.

16. A method of claim 14, wherein controlling the temperature includes controlling the amount of electrical power so as to hold the susceptor at its Curie temperature.

17. A method of claim 14, wherein sensing trends includes sensing changes in a voltage across the induction coil.

18. A method of claim 17, wherein sensing trends includes sensing a sudden increase in the voltage across the induction coil.

19. A method of claim 18, wherein controlling the temperature includes controlling the amount of electrical power so as to maintain a predetermined voltage measured by the voltage sensor after sensing the sudden increase in voltage.

20. A method of claim 14, wherein sensing trends includes sensing a sudden decrease in a current supplied to the induction coil and wherein controlling the temperature includes controlling the amount of electrical power so as to maintain a predetermined current measured by the current sensor after sensing the sudden decrease in current.

21. A method for determining when a part held in a cavity defined by a susceptor has reached a desired forming temperature, said method comprising:

generating an electromagnetic flux about the susceptor using an inductor;

detecting a step rise in voltage across the inductor due to a change in magnetic permeability of the susceptor; and correlating a Curie temperature of the susceptor with the step rise in voltage across the inductor to determine a temperature of the susceptor and the part held therein.

22. A method of claim 21, further comprising maintaining the temperature of the part by maintaining the voltage across the inductor after detecting the step rise in voltage.

* * * * *